US011049676B2

(12) United States Patent
Kadam et al.

(10) Patent No.: US 11,049,676 B2
(45) Date of Patent: Jun. 29, 2021

(54) CENTER TURN AND TWIST MECHANISM OF A SWITCHGEAR

(71) Applicant: ABB Power Grids Switzerland AG, Baden (CH)

(72) Inventors: Ajit Kadam, Pune (IN); Shashwat Chauhan, Ahmedabad (IN); Manish Sinjonia, Vadodara (IN)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/982,540

(22) PCT Filed: Mar. 11, 2019

(86) PCT No.: PCT/IB2019/051943
§ 371 (c)(1),
(2) Date: Sep. 19, 2020

(87) PCT Pub. No.: WO2019/180536
PCT Pub. Date: Sep. 26, 2019

(65) Prior Publication Data

US 2021/0005409 A1 Jan. 7, 2021

(30) Foreign Application Priority Data

Mar. 19, 2018 (IN) ..... 201841009917

(51) Int. Cl.
*H01H 31/20* (2006.01)
*H01H 31/16* (2006.01)
(Continued)

(52) U.S. Cl.
CPC ..... *H01H 31/16* (2013.01); *H01H 1/365* (2013.01); *H01H 1/44* (2013.01); *H01H 31/20* (2013.01)

(58) Field of Classification Search
None
See application file for complete search history.

(56) References Cited

U.S. PATENT DOCUMENTS 3,134,865 A * 5/1964 Bernatt ..... H01H 31/20 200/48 SB
3,705,279 A * 12/1972 Kerr, Jr. ..... H01H 31/20 200/48 SB (Continued)

FOREIGN PATENT DOCUMENTS

WO 2012/007243 A1 1/2012

OTHER PUBLICATIONS

International Search Report and Written Opinion of the International Searching Authority, PCT/IB2019/051943, dated Jul. 1, 2019, 9 pages.

*Primary Examiner* — Felix O Figueroa
(74) *Attorney, Agent, or Firm* — Sage Patent Group

(57) ABSTRACT

A switchgear having a turn and twist mechanism. The switchgear has a contact system for electrical current conduction and bus transfer switching. The contact system has a fixed contact assembly and a movable contact assembly. The turn and twist mechanism drives the movable contact assembly for engagement/disengagement of the movable contacts with the fixed contacts. The turn and twist mechanism comprises a cylindrical pipe and a driving assembly. The driving assembly comprises a driving base, a floating carrier and a driving pin arrangement, for driving the cylindrical pipe for the engagement/disengagement. The driving base drives the floating carrier for turning the cylindrical pipe about a first axis, and drives the driving pin arrangement for twisting the cylindrical pipe about a second axis.

11 Claims, 10 Drawing Sheets

(51) Int. Cl.
*H01H 1/36* (2006.01)
*H01H 1/44* (2006.01)

(56) References Cited

U.S. PATENT DOCUMENTS 5,584,379 A * 12/1996 Bischoping ..... H01H 31/16
200/48 A
8,916,785 B1 * 12/2014 Kowalik ..... H01H 1/48
200/48 R
9,147,537 B1 9/2015 Kowalik
9,208,976 B2 * 12/2015 Girlando ..... H01H 31/023

* cited by examiner

CENTER TURN AND TWIST MECHANISM OF A SWITCHGEAR

CROSS REFERENCE TO RELATED APPLICATION

This application is a 35 U.S.C. § 371 national stage application of PCT International Application No. PCT/IB2019/051943, filed on Mar. 11, 2019, the disclosure and content of which is incorporated by reference herein in its entirety.

FIELD OF THE INVENTION

The present invention generally relates to switchgear having turn and twist mechanisms. More specifically, the present invention relates to a center turn and twist mechanism of a switchgear.

BACKGROUND OF THE INVENTION

Switchgear such as disconnecters or isolators, have different configurations. One configuration of a switchgear is of a turn and twist type, wherein the switchgear comprises a turn and twist mechanism. The turning motion is where the current path (typically an elongated pipe) rotates about a fixed axis (e.g. of a driving insulator). The twisting motion is where the current path rotates about its own longitudinal axis. Depending on the configuration i.e. single break, double break, center break, side break etc., the turning and twisting mechanisms can vary.

Consider a switchgear having a center rotating arm. In such switchgear, there is a base frame that supports two post insulators, and a rotating insulating rod (drive insulator), The insulating rod supports the arm, and also rotates the arm. Here, the arm rotates about the axis of the insulating rod (i.e. turns) in response to rotation of the drive insulator. Once the arm is proximal to the fixed contact assembly (i.e. the movable contacts are about to enter/touch the fixed contacts), the arm rotates (or twists) about its own axis (longitudinal axis).

In the prior art configurations, the twisting is enabled by a lever/clamp arrangement. In these arrangements, a support plate is attached with the rotating insulator rod, and at an end of the support plate the lever/clamp is provided. The lever/clamp is attached with the support plate such that the rotation of the support plate causes the lever/clamp to impart a twisting movement to the arm (current path).

The lever/clamping arrangements for enabling the twisting motion has certain limitations. There is limited scope of having a higher degree of rotation (in twisting) when using the lever/clamping arrangements. Further, these arrangements are generally bulky, which can create dielectric problems.

With increase in demand, high voltage switchgear (e.g. around 100 kV or above) for higher current ratings (e.g. around 2000 A, or more) are desired. It is required to support bus transfer switching at such ratings. It is required to have more degree of rotation (during twisting) for bus transfer switching. Such enhancement should be provided without having dielectric problems.

In view of the above, there is a need for switchgear with an improved turn and twist mechanism.

SUMMARY OF THE INVENTION

The present invention provides a switchgear having a turn and twist mechanism for electrical connection and disconnection. For example, the switchgear is a single break or double break disconnector. Taking another example, the switchgear can be a vertical break disconnector or isolator. In one embodiment, the switchgear is a double side break disconnector that has two fixed contacts and two movable contacts.

In accordance with various embodiments, the switchgear comprises a contact system for electrical current conduction and bus transfer switching. The contact system comprising a fixed contact assembly and a movable contact assembly. The turn and twist mechanism drives the movable contact assembly for engagement or disengagement of one or more movable contacts with one or more corresponding fixed contacts. For example, the switchgear can be in an open position, and motion can be imparted to the movable contact assembly for closing the switchgear.

The movable contact assembly can have a current path pipe and one or more movable contacts. In accordance with various embodiments, the current path pipe is a cylindrical pipe, which can turn about a first axis and twist about a second axis. The first axis may be the axis of a driving insulator, while the second axis is the longitudinal axis of the cylindrical pipe.

The turn and twist mechanism comprises the cylindrical pipe and a driving assembly. During engagement, the cylindrical pipe is initially turned about the first axis, and then twisted about the second axis, for engagement of the movable and fixed contacts. Similarly, during disengagement, the cylindrical pipe is initially twisted about the second axis, and then turned about the first axis. Here, both the fixed and moving contact assemblies have main and arcing (bus transfer) contacts. In accordance with various embodiments, the arcing contacts are the first to engage and the last to disengage. In the closed position, the main contacts are fully engaged, while the arcing contacts are disengaged.

In accordance with various embodiments, the driving assembly comprises a driving base, a floating carrier, and a driving pin arrangement. The driving assembly is mechanically coupled with the cylindrical pipe. The coupling is such that the driving assembly can cause turning/twisting of the cylindrical pipe for the engagement/disengagement. The driving base is mounted for rotating about the first axis. For example, the driving base can be a plate, mounted on a driving insulator rod (e.g. center insulator). Thus, the driving base can be rotated about the axis (first axis) by the driving insulator.

The rotation of the driving base is in two stages, wherein in one stage the rotation of the driving base translates to the turning of the cylindrical pipe about the first axis. In another stage, the rotation of the driving base translates to the twisting of the cylindrical pipe about the second axis. To have electrical current conduction between the movable and fixed contacts, the switchgear has to be moved from an open to a closed position. Here, during a first stage of rotation, the driving base drives the floating carrier for the turning of the cylindrical pipe about the first axis, and during a second stage of the rotation, the driving base drives the driving pin arrangement for the twisting of the cylindrical pipe about the second axis. Similarly, for disconnection, initially the driving base drives the driving pin arrangement for the twisting of the cylindrical pipe, and thereafter the driving base drives the floating carrier for the turning of the cylindrical pipe.

The floating carrier is mounted on the driving base. In accordance with various embodiments, the floating carrier comprises two parallel plates having circular openings for supporting the cylindrical pipe during the turning and twisting. For example, the two parallel plates can be connected with a flat piece, which can have slots for mounting on the driving base (e.g. using bushes). The two parallel plates are arranged such that centers of the circular openings are positioned on the second axis (or the longitudinal axis of the cylindrical pipe).

The floating carrier is mechanically coupled with the movement of the driving base. The coupling is such that during the corresponding stage (i.e. first stage or stage during turning of the cylindrical pipe) of rotation, the floating carrier rotates about the first axis in response to the rotation of the driving base, and in turn rotates the cylindrical pipe about the first axis.

In one embodiment, the driving base and the floating carrier are connected with two springs. Here, provisions are provided on the driving base and the floating carrier for the connection. For example, the driving base and the floating carrier have protrusions. The driving base can have a slot for mounting on the driving mechanism (e.g. center insulator). Two protrusions can be provided on edges proximal to the center of the driving base. Each plate of the floating carrier can have a corresponding protrusion about an edge of the plate. Thus, the two springs connect the driving base with the floating carrier. Here, one end of each spring is connected with a protrusion of the driving base and the other end is connected with a corresponding protrusion of the floating carrier. Thus, as the driving base rotates, the connection with the springs translates the rotating motion to the floating carrier, which in turn rotates the cylindrical pipe about the first axis.

The mounting of the floating carrier is such that there can be relative movement between the driving base and the floating carrier. Here, the driving base continues to rotate (e.g. during the second stage, or the twisting stage), while the floating carrier remains stationary.

The relative movement between the floating carrier and the driving base is to have the twisting movement of the cylindrical pipe. In accordance with an embodiment, the driving base comprises one or more slots for having the relative movement. The slots (or grooves) on the driving base can be used to limit the rotation of the driving base. For example, the slots can be used to connect stoppers (e.g. screws). The screws can attach the floating carrier with the driving base (e.g. using spacers). The screws can act as stoppers for limiting the rotating movement of the driving base.

The rotating movement of the driving base is translated to the twisting movement of the cylindrical pipe through the driving pin arrangement. The driving pin arrangement comprising three pins. Two pins of the driving pin arrangement are mounted on the driving base and one pin is attached with the cylindrical pipe. In an embodiment, the two pins mounted on the driving base are parallel to each other. Further, the pins are mounted perpendicularly on the driving base.

The third pin (attached with the cylindrical pipe) is mechanically coupled to the movement of the two parallel pins mounted on the driving base. The mechanical coupling is such that during the second stage of rotation of the driving base, the rotation of the driving base causes the two pins mounted on the driving base to move the third pin for rotating the cylindrical pipe about the second axis (or its longitudinal axis).

In an embodiment, the third pin of the driving pin arrangement is perpendicular to the two pins mounted on the driving base. The third pin can be attached with the cylindrical pipe using a collar assembly. The collar assembly can have a circular opening (e.g. having a diameter of the cylindrical pipe) for connection between the collar assembly and the cylindrical pipe. Further, the collar assembly can have an opening for mounting of the third pin parallel to the longitudinal axis of the cylindrical pipe.

Thus, the third pin can be attached in perpendicular to the two parallel pins, and arranged (or locked) between the two parallel pins. Accordingly, when the two parallel pins move as a result of the rotation of the driving base, the third pin moves to rotate the cylindrical pipe about the longitudinal axis (or twist). Here, the two parallel pins can rotate till the movement is limited (e.g. by the screws connecting the floating carrier with the driving base on the slots).

Thus, the turn and twist mechanism of the present invention enables engagement for electrical current conduction. During engagement for electrical current conduction, the driving base drives the floating carrier to turn the cylindrical pipe about the first axis (i.e. during the corresponding (e.g. first) stage of rotation) to bring the movable contact assembly proximal to the fixed contact assembly. Thereafter, the driving base drives the driving pin arrangement to twist the cylindrical pipe about the second axis during the corresponding (e.g. second) stage of rotation for engagement of the one or more movable contacts with the one or more corresponding fixed contacts. Similarly, during disengagement, the driving base drives the driving pin arrangement to twist the cylindrical pipe about the second axis, and thereafter drives the floating carrier to turn the cylindrical pipe about the first axis.

BRIEF DESCRIPTION OF DRAWINGS

The subject matter of the invention will be explained in more detail in the following text with reference to exemplary embodiments which are illustrated in attached drawings in which.

DETAILED DESCRIPTION

Figure 1A:
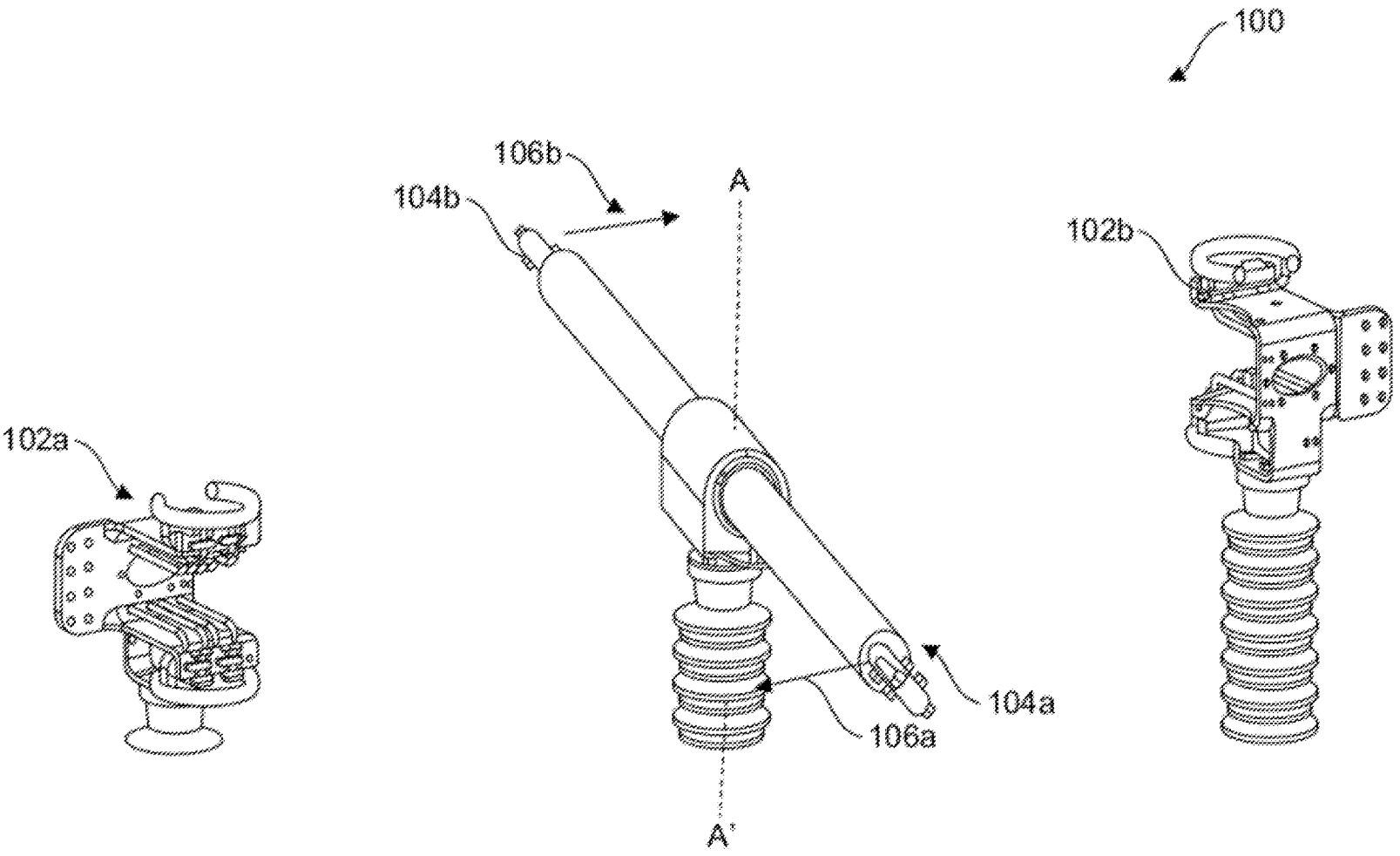
FIGS. 1A and 1B show perspective views of a switchgear having a turn and twist mechanism, in accordance with an embodiment of the invention.
Figure 1B:
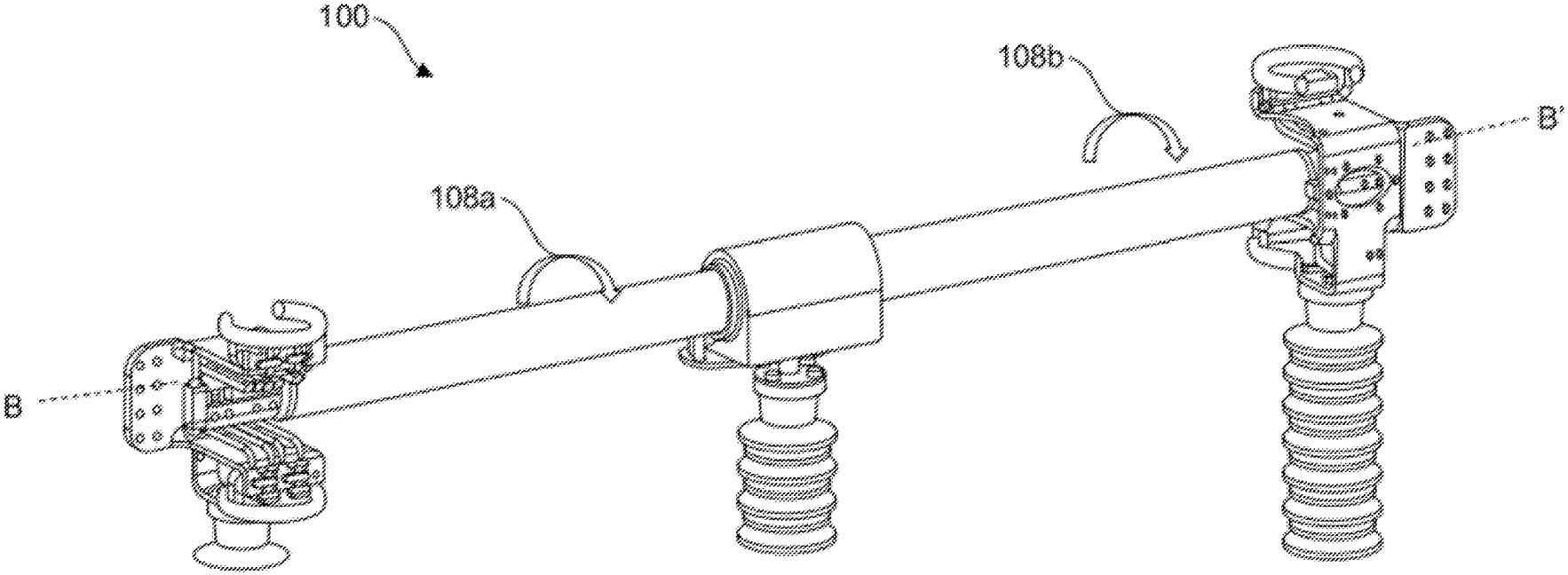

The present invention provides a switchgear with a turn and twist mechanism. The switchgear of the invention has a contact system having contacts for bus transfer switching. FIGS. 1A and 1B show an embodiment wherein the switchgear is a disconnector (100). In accordance with the embodiment, the disconnecter is a double side break disconnector. In FIG. 1A, the disconnector is in an open position, from which it can turn to a position for closing as shown in FIG.

1B. In the embodiment of FIGS. 1A and 1B, the disconnector has two fixed contacts (102*a*, 102*b*) and two movable contacts (104*a*, 104*b*).

Figure 2A:
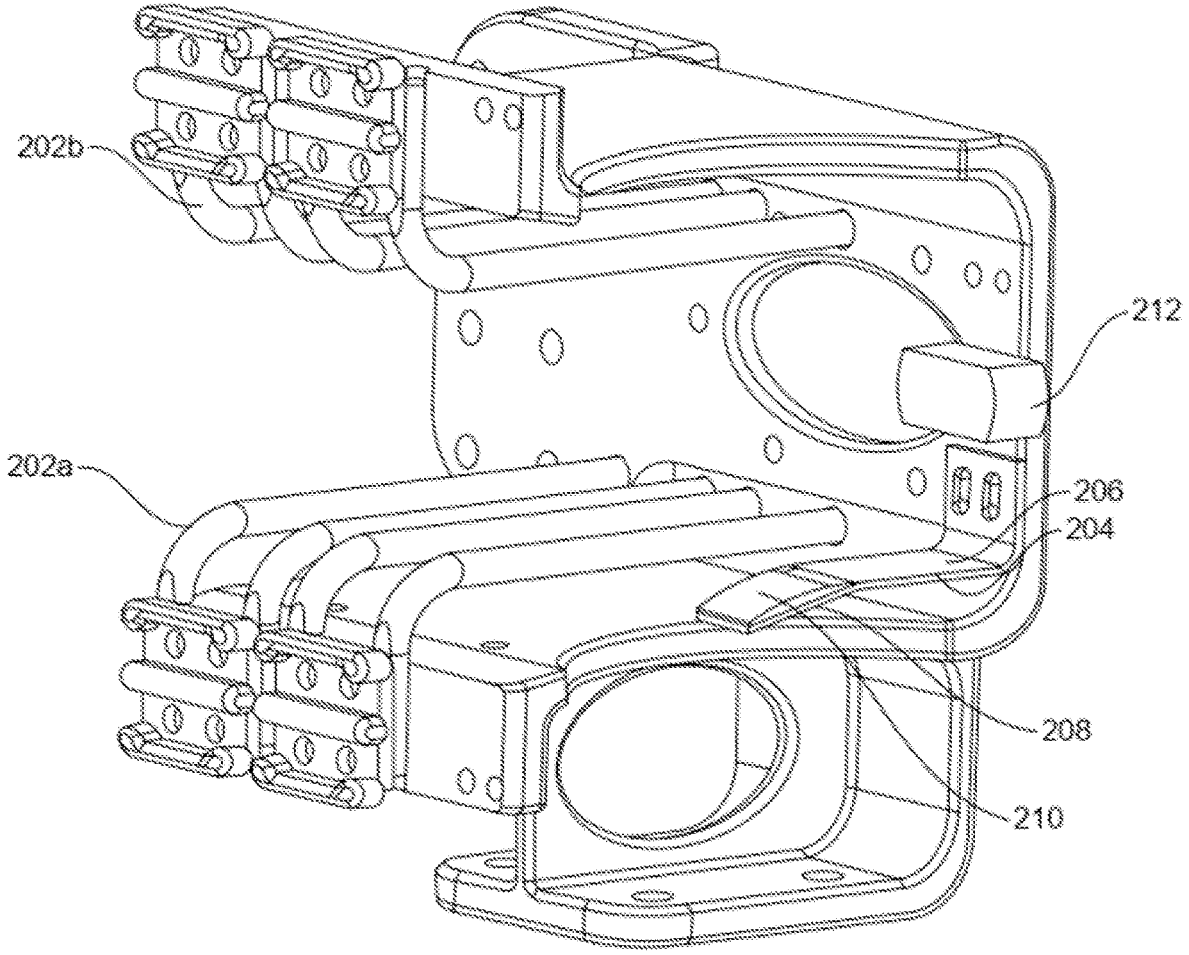
FIGS. 2A and 2B shows a perspective view of a fixed contact assembly of the switchgear, in accordance with an embodiment of the invention.
Figure 2B:
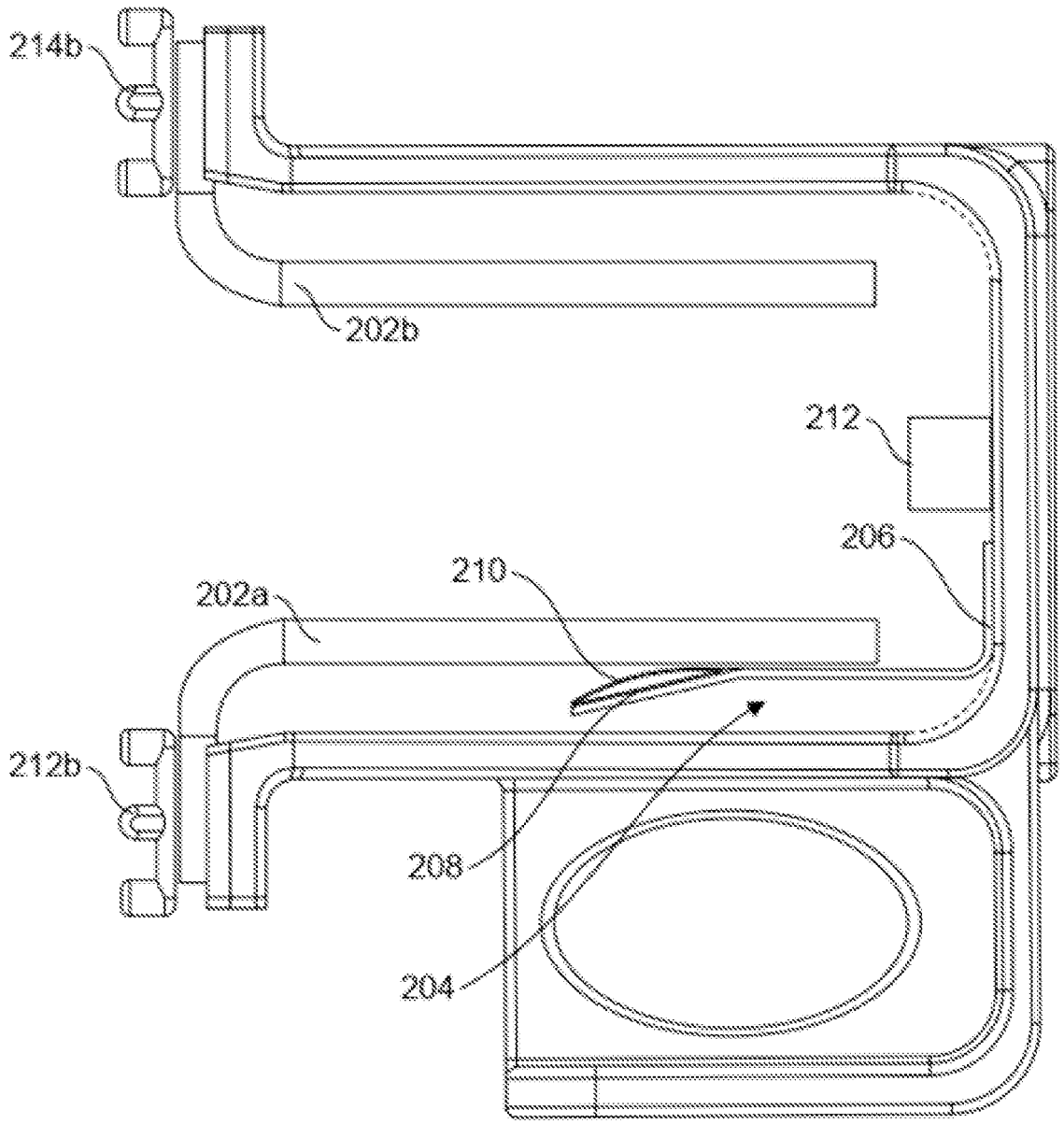

FIGS. 2A and 2B show shows a fixed contact assembly of the switchgear, in accordance with an embodiment of the invention. As shown, the fixed contact assembly has a fixed main contact (primary contact) and a fixed arcing contact (also referred herein as auxiliary contact). The main and arcing contacts are attached with a casting as shown in FIGS. 2A and 2B. In the embodiment, the main contact comprises a first set (202*a*) and a second set (202*b*) of main contact fingers. As shown, each set can have multiple contact fingers that are of similar size and shape, and are positioned in parallel to each other. In the embodiment of FIGS. 2A and 2B, each contact finger is L-shaped and attached with the plate at one end (214*a*, 214*b*) as shown such that the contact fingers in the corresponding set are parallel to each other. The number of contact fingers in each set can be determined based on the rating of the switchgear.

The arcing contact (204) is a contact finger for bus transfer switching. In accordance with the embodiment, the arcing contact is proximal to the first set of contact fingers (202*a*). Further, the arcing contact is positioned slightly lower than the first set of contact fingers for corresponding engagement with a movable arcing contact.

In accordance with the embodiment shown in FIGS. 2A and 2B, the arcing contact is substantially flat, with a first portion (206) of the contact being parallel to the main contact fingers, and a second portion (208) of the contact being at an angle to the first portion. It will be apparent that the contact finger is bent at a line, making the two flat surfaces at an angle to each other. The arcing contact has a contacting element (210) on the second portion, for engaging with a movable arcing contact. Thus, the arcing contact acts as a leaf spring and a current carrying system. In the embodiment shown in FIGS. 2A and 2B, the fixed contact assembly also comprises a mechanical stopper (212). In accordance with some embodiments, the stopper is for stopping the turning movement of the movable contact assembly.

Figure 3:
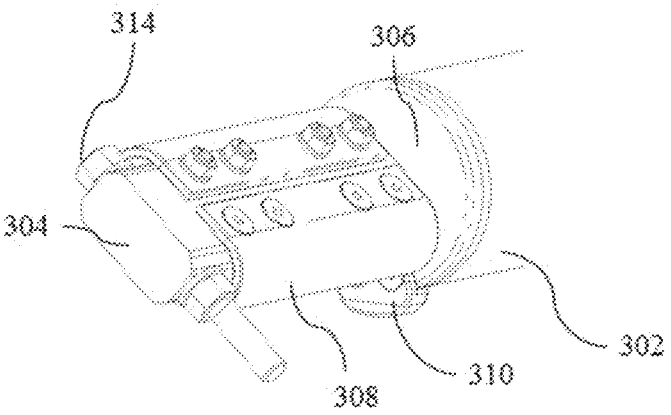
FIGS. 3, 4 and 5 show perspective views of a movable contact assembly of the switchgear, in accordance with an embodiment of the invention.
Figure 4:
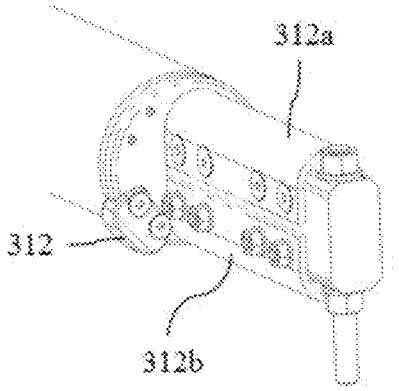
Figure 5:
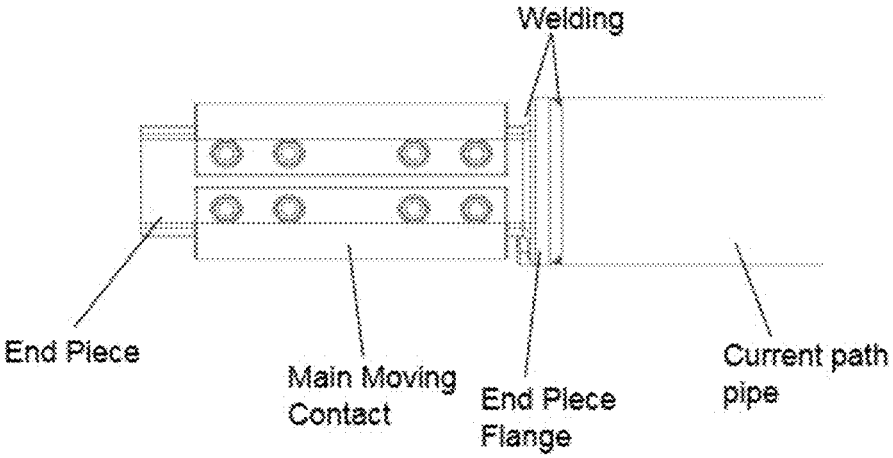

FIGS. 3, 4 and 5 show a movable contact assembly of the switchgear, in accordance with an embodiment of the invention. The movable contact assembly comprises a current path pipe (302) and an end piece (304). As shown, the current path pipe is a cylindrical pipe and the end piece is a rectangular block. Further as shown, dimensions (length, breadth) of the rectangular block are less than diameter of the cylindrical pipe. Here, the rectangular block is attached with the cylindrical pipe at an end. In accordance with the embodiment, as highlighted in FIG. 5, the rectangular block is attached (e.g. welded) at the end of the cylindrical pipe with a flange (306) of the rectangular block.

The movable contact assembly comprises a movable main contact (308) and the movable arcing contact (310). The movable main contact can be a single contact or a contact with two or more contacting elements. In the embodiment of FIGS. 3 and 4, the main contact (or primary contact) comprises two u-shaped contacting elements (312*a*, 312*b*) provided on the rectangular block as shown. Further, as shown, the movable arcing contact is provided at the end of the cylindrical pipe. Here, the arcing contact is provided on a portion (312) about the periphery (peripheral portion) of the cylindrical pipe.

As shown in FIGS. 3 and 4, the movable arcing contact is positioned such that a portion of the movable arcing contact protrudes at the portion of about the periphery of the cylinder. Further as shown, the movable arcing contact is attached with the cylindrical pipe, at a portion of the movable arcing contact that is within the periphery of the cylindrical pipe. The movable arcing contact is provided such that at the end of the turning movement of the movable contact assembly, initially the arcing contacts (of fixed/movable contact assembly) engage, after which commutation happens, in which the arcing contacts gradually disengage and the primary contacts engage.

The movable contact assembly can rotate about two axes. Referring to FIG. 1, the cylindrical pipe can rotate or turn (106*a*, 106*b*) about a first axis (AA'), and twist (108*a*, 108*b*) about a second axis (BB'). As shown in FIG. 1, the first axis is a vertical axis (e.g. axis of the insulator), about which the cylindrical pipe can rotate to move the movable contact assembly (or assemblies) to bring the movable contacts proximal to the fixed contacts. Further, as shown, the second axis is a horizontal axis (e.g. the axis of the cylindrical pipe), about which the pipe can rotate (or twist) to move the movable contact assembly (or assemblies) relative to the fixed contact assembly (or assemblies).

Figure 6:
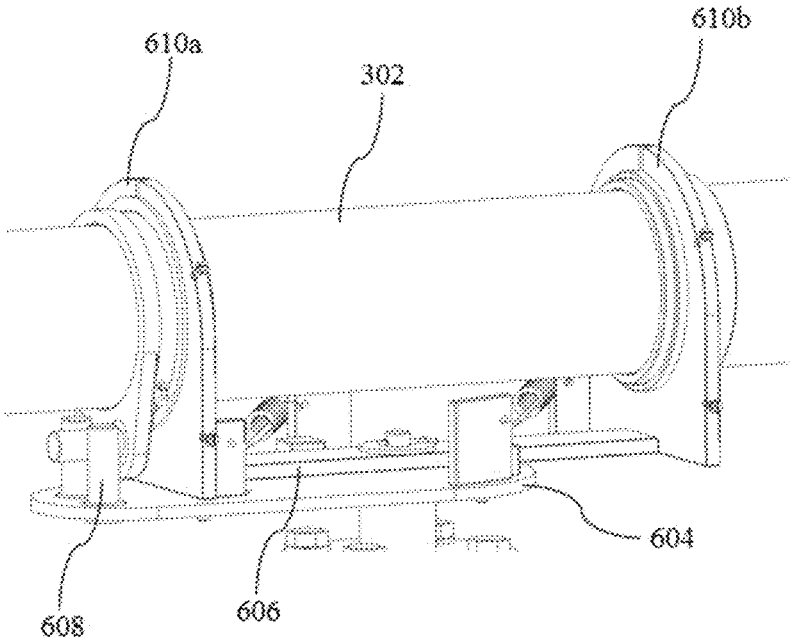
FIG. 6 shows a perspective view of the turn and twist mechanism, in accordance with an embodiment of the invention.
Figure 7:
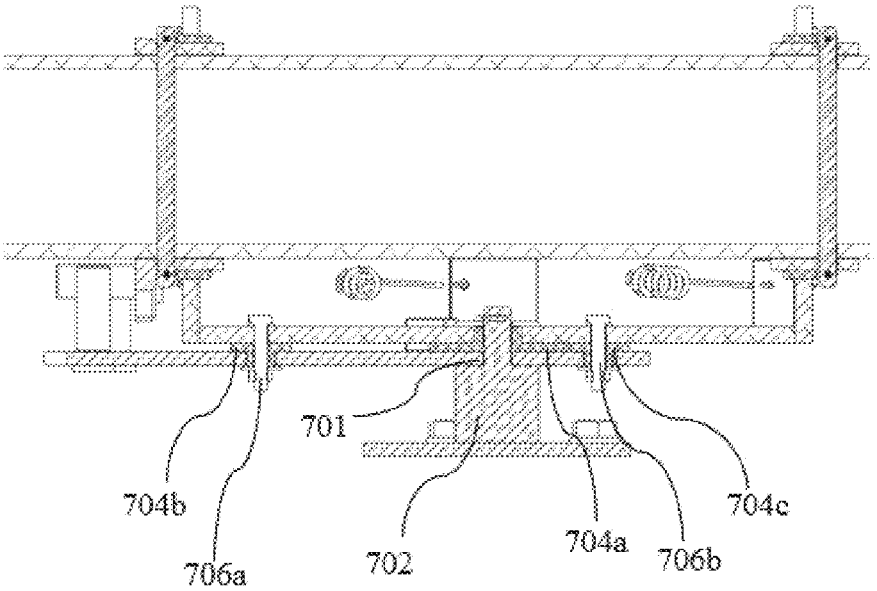
FIG. 7 shows a sectional view of the turn and twist mechanism, in accordance with the embodiment of the invention.

Referring to FIG. 6, which shows the turn and twist mechanism of the present invention, in accordance with an embodiment. As shown, the turn and twist mechanism comprises the cylindrical pipe (302), and a driving assembly. The driving assembly comprises a driving base (604), a floating carrier (606), and a driving pin arrangement (608). As shown in FIG. 7, the driving base can be mounted for rotation about the first axis. For example, the driving base can be mounted on an insulator as shown in FIG. 7. The driving base may be welded as a single piece having a plate for mounting on the insulator. Thus, the driving base can be rotated by the driving insulator about the axis of the driving insulator (i.e. first axis AA').

The floating carrier is connected with the driving base. As shown, the floating carrier comprises two parallel plates (610*a*, 610*b*) having circular openings for supporting the cylindrical pipe during the turning and twisting. Here, the circular openings are such that the current path pipe can fit into the circular openings. For instance, the openings can have a diameter of about the cylindrical pipe, and the centers of the openings can be positioned about the second axis (BB').

The movement of the floating carrier can accordingly move the current path pipe. In accordance with the embodiment of FIGS. 6-9B, the floating carrier is mounted on the driving base. The mounting can be done with one or more bushes or spacers (704*a*, 704*b*, 704*c*), to have relative movement between the driving base and the floating carrier. As shown in FIG. 8B, slots (802*a*, 802*b*) are provided in the driving base to lock relative motion between the floating carrier and the driving base. In accordance with the embodiment, the support spacers (706*a*, 706*b*) move inside the slots of the driving base during operation.

Figure 8A:
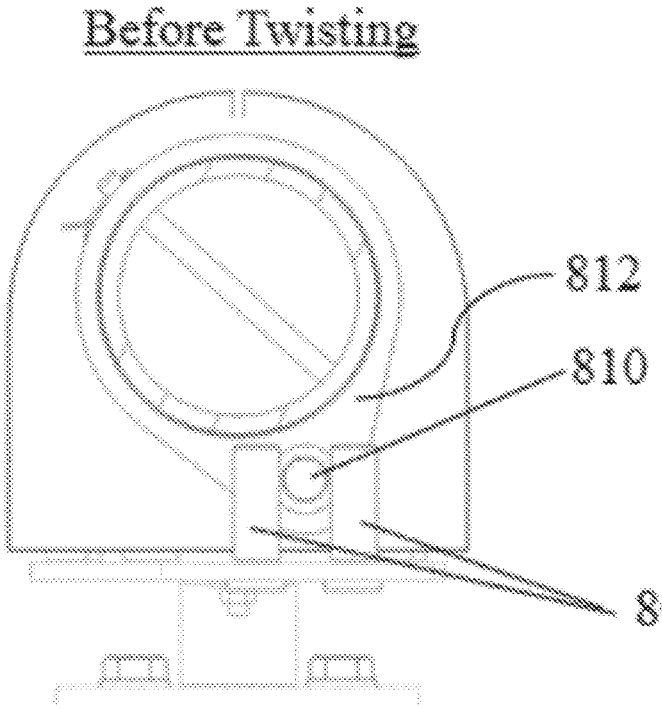
FIGS. 8A to 9B show perspective views of the turn and twist mechanism before and after twisting, in accordance with an embodiment of the invention.
Figure 8B:
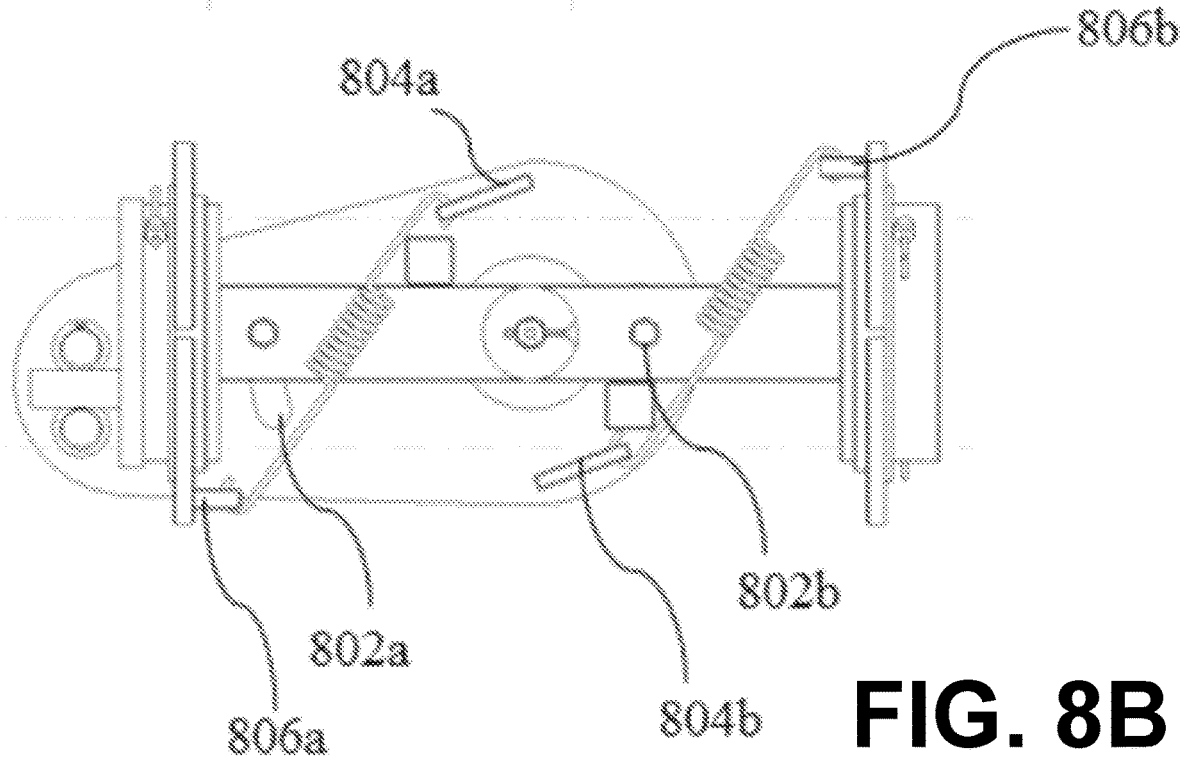
Figure 9A:
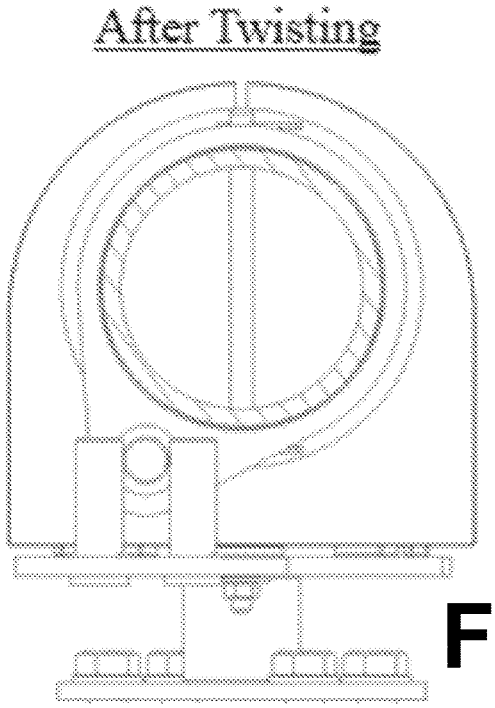
Figure 9B:
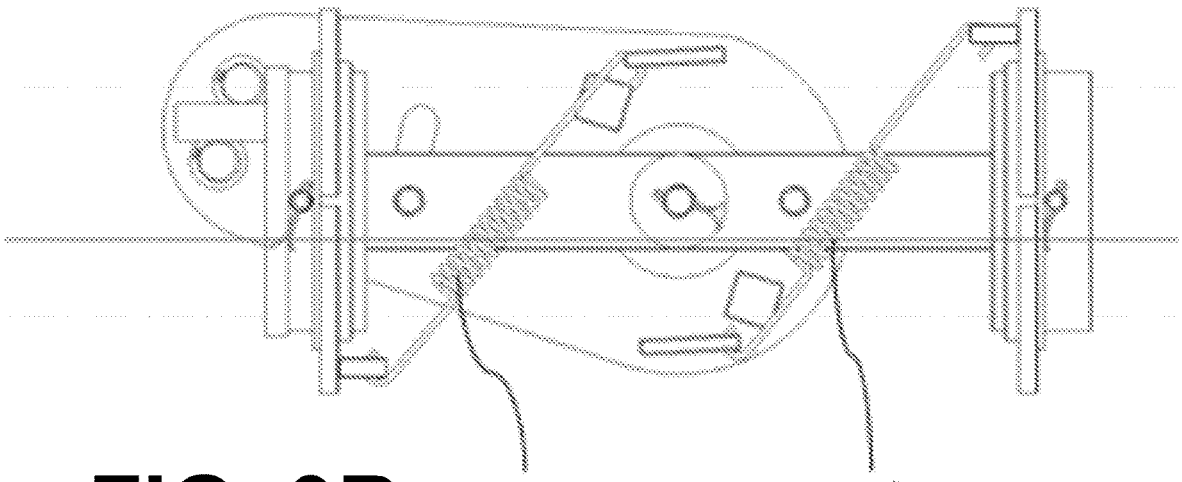

In accordance with the embodiment, as shown in FIG. 9B, two extension springs (912*a*, 912*b*) are used in the turn and twist mechanism. One end of each spring is mounted on the driving base and one end is mounted on the floating carrier. Protrusions can be provided on the driving base (804*a*, 804*b*) and the floating carrier (806*a*, 806*b*) for connecting the springs. As there is a relative motion between the floating carrier and the driving base, this motion is locked with the use of extension springs. In the first stage rotation shown in FIGS. 8A and 8B (before twisting), components of the turn and twist mechanism including the current path (cylindrical pipe) will move together with the rotating insulator. Once the current path reaches to its limit position, it will come in contact with the physical stopper (212) provided in the fixed contact housing.

The remaining motion of the driving base is used in twisting the current path from the driving base. The twisting motion is enabled with the driving pin arrangement. As shown in FIGS. 8A-9B, the driving pin arrangement comprising three pins. Two pins (808*a*, 808*b*) of the driving pin arrangement are mounted on the driving base and one pin (810) is attached with the cylindrical pipe. In the embodiment shown, the two pins mounted on the driving base are parallel to each other and the pins are mounted perpendicularly on the driving base. Further, the third pin is perpendicular to the two parallel pins mounted on the driving base. As shown, the third pin is attached with the cylindrical pipe using a collar assembly (812). The collar assembly has a circular opening for connection between the collar assembly and the cylindrical pipe. Further, the collar assembly has an opening for mounting of the third pin parallel to the longitudinal axis of the cylindrical pipe.

Thus, once the twisting movement begins, the turn and twist mechanism is in a position shown in FIGS. 8A and 8B. Here, relative movement between the floating carrier and the driving base will happen. In this stage, the driving base rotates and drives the driving pin arrangement. This rotation is limited by the slots (802*a*, 802*b*). As shown, during rotation the driving base rotates from a position shown in FIGS. 8A and 8B to a position shown in FIGS. 9A and 9B. The two parallel pins in turn move the third pin, which twists the current path pipe and closes the switchgear. In the embodiment shown, the extension spring gets elongated. The elongated spring helps in quickly untwisting the current path during opening. So, it can be seen that spring plays important role in closing and opening of the switchgear.

Figure 10:
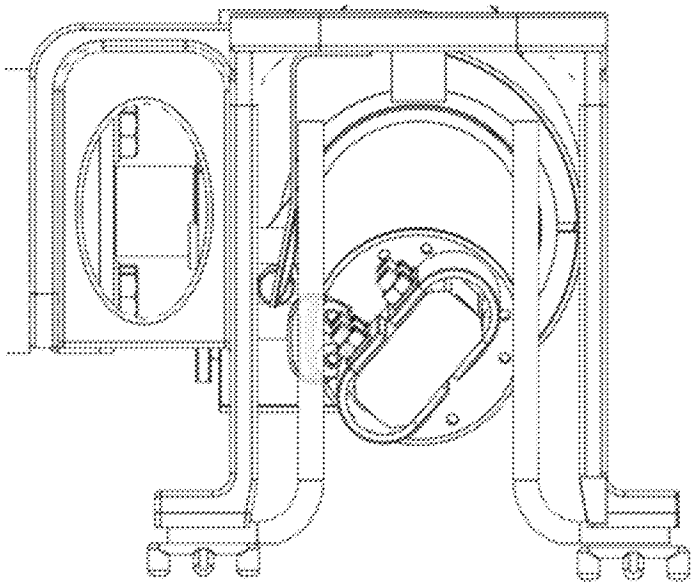
FIGS. 10-13 show different side views during engagement of the movable and fixed contact assemblies during switching, in accordance with an embodiment.

The following describes the position of the contacts during switching, in accordance with an embodiment. Turing the movable contact assembly results in the movable contact assembly to come to a position as shown in FIG. 10. During closing, the current path enters the fixed contact assembly at an angle (e.g. around 50° w.r.t vertical). The angle of current path is set in such way that sufficient clearance is maintained between the primary contacts to prevent arcing between the primary contacts during closing.

Figure 11:
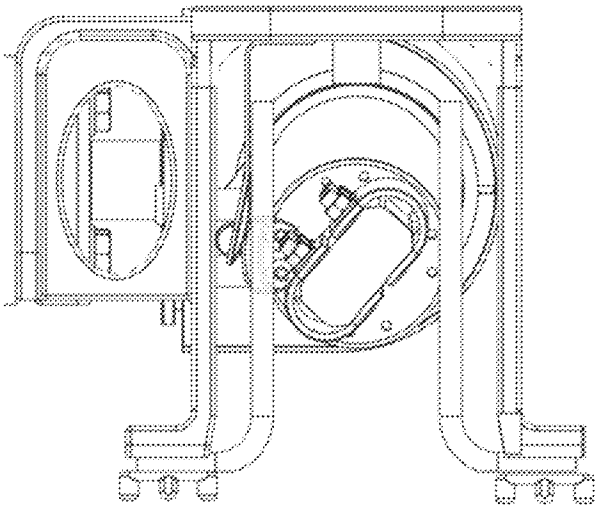

The current path pipe turns till the pipe touches the stopper. FIG. 11 shows the position of the contacts just before twisting. Thus, when the current path further moves inside the fixed contact, the arcing contacts first touch each other and arcing occurs only between the arcing contacts.

Figure 12:
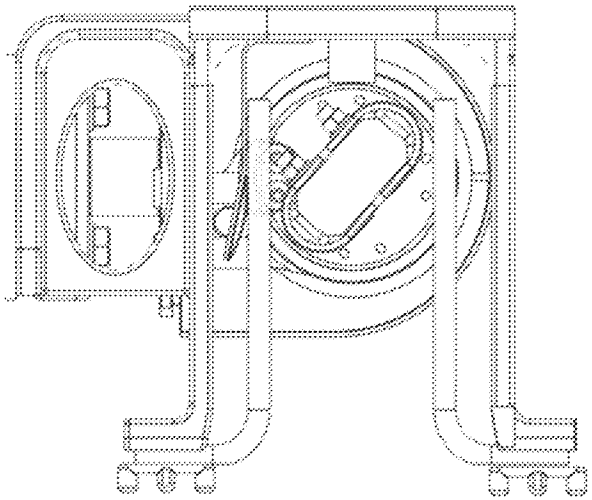

FIG. 12 shows the position of the contacts during commutation. When the current path touches the stopper (212, FIG. 2), it starts twisting. During this stage, the arcing contacts are gradually disengaging and the primary contacts are gradually engaging. The contacts are designed in such a way that there is sufficient overlap of contacts for smooth switching of current from arcing contacts to primary contacts.

Figure 13:
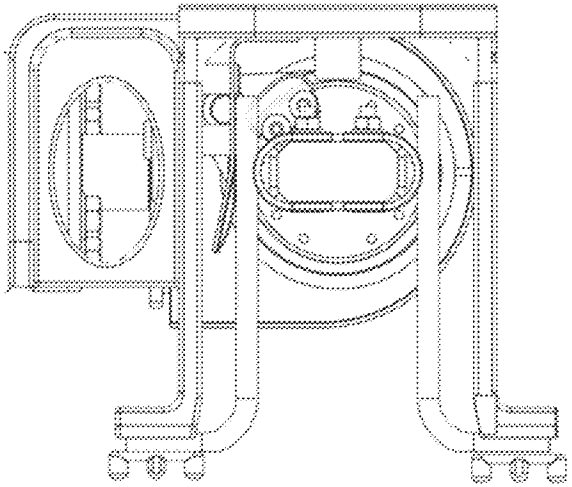

FIG. 13 shows the position of the contacts in full close condition. When the current path fully twists, the switchgear comes to full close condition. In an embodiment, the current path twists by 50° for the switchgear to come to a full close condition. In the full close condition, the arcing contacts completely disengage and the primary contacts engage completely as shown. In this position, the rated current flows only from the primary contacts.

The turn and twist mechanism of the present invention provides for greater twisting, which allows for adding the auxiliary (or bus transfer) contacts. The mechanism of the present invention provides for greater twisting of the current path as compared to the prior art twisting mechanisms. The pin arrangement helps in achieving twisting of about 50 degrees. This assists in having good amount of clearance between the fixed and movable contacts before twisting, which allows for adding auxiliary contact for bus transfer. Here, even if there is slightly misalignment in the current path and fixed contact at the end of the turning motion, the main contacts do not touch as there is sufficient clearance. The supports (bushes, spacers) connecting the floating carrier and the driving bush provide extra stability and prevent accidental over-twisting. They also provide for ease of assembly of the center turn and twist mechanism.

We claim:

1. A switchgear having a turn and twist mechanism for electrical connection and disconnection, the switchgear comprising a contact system for electrical current conduction and bus transfer switching, the contact system comprising a fixed contact assembly and a movable contact assembly, wherein the turn and twist mechanism drives the movable contact assembly for one of engagement and disengagement of one or more movable contacts with one or more corresponding fixed contacts, the turn and twist mechanism comprising:

a cylindrical pipe of the movable contact assembly, for turning about a first axis and twisting about a second axis, for one of engagement and disengagement of the one or more movable contacts with the one or more corresponding fixed contacts of the contact system; and a driving assembly comprising a driving base, a floating carrier, and a driving pin arrangement, wherein the driving assembly is mechanically coupled with the cylindrical pipe, wherein the driving base is mounted for rotating about the first axis, wherein during a first stage of rotation, the driving base drives the floating carrier for turning the cylindrical pipe about the first axis, and during a second stage of rotation, the driving base drives the driving pin arrangement for twisting the cylindrical pipe about the second axis, wherein the floating carrier is mounted on the driving base and mechanically coupled with the movement of the driving base such that during the first stage of rotation the floating carrier rotates about the first axis in response to the rotation of the driving base, and in turn rotates the cylindrical pipe about the first axis, wherein the floating carrier comprises two parallel plates having circular openings for supporting the cylindrical pipe such that centers of the circular openings are positioned on the second axis, wherein the driving pin arrangement comprising three pins, wherein two pins are two parallel pins mounted on the driving base, and a third pin is attached with the cylindrical pipe, such that the third pin is mechanically coupled to the movement of the two parallel pins mounted on the driving base, wherein during the second stage of rotation, the rotation of the driving base causes the two parallel pins to move the third pin for rotating the cylindrical pipe about the second axis, and wherein during engagement for electrical current conduction, the driving base drives the floating carrier to turn the cylindrical pipe about the first axis during the first stage of rotation to bring the movable contact assembly proximal to the fixed contact assembly, and the driving base drives the driving pin arrangement to twist the cylindrical pipe about the second axis during the second stage of rotation for engagement of the one or more movable contacts with the one or more corresponding fixed contacts.

2. The switchgear of claim 1, wherein the driving base comprises one or more slots for limiting the rotation of the driving base during the second stage of rotation.

3. The switchgear of claim 1, wherein the third pin of the driving pin arrangement is perpendicular to the two parallel pins mounted on the driving base.

4. The switchgear of claim 1, wherein the third pin is attached with the cylindrical pipe using a collar assembly, wherein the collar assembly comprises a circular opening for connection between the collar assembly and the cylindrical pipe, and wherein the collar assembly comprises an opening for mounting of the third pin parallel to the longitudinal axis of the cylindrical pipe.

5. The switchgear of claim 1, wherein the driving base and the floating carrier are connected with two springs, wherein one end of each spring is connected with the driving base and the other end is connected with the floating carrier.

6. The switchgear of claim 1, wherein the driving base is mounted on a driving mechanism and comprises two protrusions provided on edges.

7. The switchgear of claim 6, wherein each plate of the floating carrier comprises a protrusion about an edge of the plate, wherein two springs connect the driving base with the floating carrier, wherein one end of each spring is connected with a protrusion of the driving base and the other end is connected with a corresponding protrusion of the floating carrier.

8. The switchgear of claim 1, wherein the switchgear is a double side break disconnector.

9. The switchgear of claim 1, wherein during disengagement, the driving base drives the driving pin arrangement to twist the cylindrical pipe about the second axis, and thereafter drives the floating carrier to turn the cylindrical pipe about the first axis.

10. A method in a switchgear having a turn and twist mechanism for electrical connection and disconnection, the switchgear comprising a contact system for electrical current conduction and bus transfer switching, the contact system comprising a fixed contact assembly and a movable contact assembly, wherein the turn and twist mechanism drives the movable contact assembly for one of engagement and disengagement of one or more movable contacts with one or more corresponding fixed contacts, the method comprising:

rotating a driving base of a driving assembly of the switchgear about a first axis in a first direction to engage the one or more movable contacts with the one or more corresponding fixed contacts, the driving assembly comprising the driving base, a floating carrier, and a driving pin arrangement, wherein the driving assembly is mechanically coupled with a cylindrical pipe of the movable contact assembly, the cylindrical pipe for turning about the first axis and twisting about a second axis, for one of engagement and disengagement of the one or more movable contacts with the one or more corresponding fixed contacts of the contact system, wherein during a first stage of rotation in the first direction, the driving base drives the floating carrier for turning the cylindrical pipe about the first axis, and during a second stage of rotation, the driving base drives the driving pin arrangement for twisting the cylindrical pipe about the second axis, wherein the floating carrier is mounted on the driving base and mechanically coupled with the rotation of the driving base such that during the first stage of rotation, the floating carrier rotates about the first axis in response to the rotation of the driving base, and in turn rotates the cylindrical pipe about the first axis, wherein the floating carrier comprises two parallel plates having circular openings for supporting the cylindrical pipe such that centers of the circular openings are positioned on the second axis, wherein the driving pin arrangement comprising three pins, wherein two pins are two parallel pins mounted on the driving base, and a third pin is attached with the cylindrical pipe, such that the third pin is mechanically coupled to movement of the two parallel pins mounted on the driving base, wherein during the second stage of rotation, the rotation of the driving base causes the two parallel pins to move the third pin for rotating the cylindrical pipe about the second axis;

responsive to rotating the driving base in the first direction, the driving base drives the floating carrier to turn the cylindrical pipe about the first axis during the first stage of rotation to bring the movable contact assembly proximal to the fixed contact assembly, and the driving base drives the driving pin arrangement to twist the cylindrical pipe about the second axis during the second stage of rotation for engagement of the one or more movable contacts with the one or more corresponding fixed contacts; and rotating the driving base of the driving assembly of the switchgear about the first axis in a second direction to disengage the one or more movable contacts with the one or more corresponding fixed contacts, wherein responsive to rotating the driving base about the first axis in the second direction, the driving base drives the driving pin arrangement to twist the cylindrical pipe about the second axis, and thereafter drives the floating carrier to turn the cylindrical pipe about the first axis to move the movable contact assembly away from the fixed contact assembly.

11. The method of claim 10, further comprising limiting the rotation of the driving base during the second stage of rotation.

* * * * *